US005673734A

United States Patent [19]

Hawley

[11] Patent Number: 5,673,734

[45] Date of Patent: Oct. 7, 1997

[54] SAND SCOOP

[76] Inventor: Robert Charles Hawley, 3072 Calle Pinon, Santa Barbara, Calif. 93105

[21] Appl. No.: 544,845

[22] Filed: Oct. 18, 1995

[51] Int. Cl.[6] ..... B65B 1/04; B65B 3/04; B67C 3/02

[52] U.S. Cl. ..... 141/108; 141/10; 141/114; 141/314; 294/55; 209/418

[58] Field of Search ..... 141/108, 10, 114, 141/314, 315, 316; 294/55; 53/570, 390, 384.1; 209/418

[56] References Cited

U.S. PATENT DOCUMENTS

| | | | |
|---|---|---|---|
| 112,727 | 4/1871 | Lum | 141/108 |
| 121,529 | 12/1871 | Lum | 141/108 |
| 1,182,412 | 5/1916 | Olesberg | 141/108 |
| 3,255,570 | 6/1966 | Weimer | 141/108 |
| 3,916,962 | 11/1975 | Stolt | 141/108 |
| 5,107,666 | 4/1992 | Rahtican | 294/55 |
| 5,205,107 | 4/1993 | Herink | 294/55 |
| 5,316,060 | 5/1994 | Hodgdon et al. | 141/108 |
| 5,575,315 | 11/1996 | Wengert | 141/10 |

*Primary Examiner*—Henry J. Recla
*Assistant Examiner*—Timothy L. Maust

[57] ABSTRACT

A scoop which is used to deposit sand or other particulate material into a bag. The scoop can be temporarily secured to the bag while its rear end is partially disposed within the bag. The envisioned purpose for this scoop is to permit one person to quickly and efficiently fill a bag with sand. During situations where flooding or mudslides appear imminent, the ability of an individual to quickly fill sandbags multiplied by a number of individuals performing the same function, can increase dramatically the number of sandbags filled for a given period of time in contrast to other conventional methods.

10 Claims, 2 Drawing Sheets

SAND SCOOP

BACKGROUND AND SUMMARY OF THE INVENTION

This invention relates to a scoop capable of filling bags or sacks with smaller particulate matter such as sand, gravel, or grain more efficiently when manual filling of bags is required.

It is well known that bags can be filled with smaller particulate matter either by machine or manually. However, under certain circumstances, machine filling is impractical and manual filling is required.

An example where machine filling of bags is not practical is where sandbags are filled quickly and used to form temporary barriers for the protection of residential homes as well as commercial property which are susceptible to damage from flooding or mudslides. In this example, there is a need for a device to improve the speed at which sandbags can be filled, which is inexpensive, lightweight and can later be disposed in an environmentally safe manner.

Another example where a need exists to quickly fill sandbags is when military personnel during training exercises or battlefield operations are constructing temporary walls to protect against small-arms fire.

Sandbags, as described in both of the above examples are usually made out of burlap or other tear-resistant fabric although they can also be manufactured from tear-resistant plastic material.

One of the most common ways to manually fill a bag requires the cooperation of two persons. The first person will hold the bag open while the second person fills the bag with sand by either using his hands, a shovel or other suitable device. This common method is highly inefficient since it requires two persons to perform the filling operation.

The second common way is for one person to hold and maintain the bag open with one hand while the other hand is used to fill the bag with sand. A shovel or other means to deliver sand into the bag is employed by the free hand. This second method also suffers from inefficiency since only one hand is available to transfer sand into the bag.

The present invention addresses the flaws associated with both of the common methods described above.

The present invention permits one person to efficiently fill a bag with smaller particulate matter. The invention is ideally suited for granular material, de-hydrated grain, mulch, lawnmower grass-cuttings and other small sized material. To function in the most efficient manner, a larger quantity of the small sized material is provided in the form of a mound, sandpile or the like. The scoop, partially disposed within a collection bag is thereafter displaced partially into the mound, and angled slightly to permit the sand to gravitate into the bag. Further, the invention has been designed to fill larger bags where it would be more practical to use two hands instead of one.

As discussed above, during times of potential flooding or mudslides, various relief agencies will mobilize and other individuals will volunteer to help protect structures and property from being damaged. Typically, skiploaders or dumptrucks are used to transport sand to sandbag filling sites. Individuals will gather at these sites to fill sandbags and subsequently use them to form temporary barriers to protect property. Under such circumstances, time is of the essence and these individuals must work as quickly and efficiently as possible.

The present invention could be provided to each person participating in a sandbag filling operation. The number of persons actually filling sandbags would increase when compared to the two person approach described above. With more people actually filling sandbags, the end result is that more sandbags could be filled in a shorter period of time.

The invention comprises a generally semi-rigid scoop-shaped configuration with an open top, a front end, a back end, two side ends and a receiving surface. Preferably, the two side ends taper to the front of the scoop to define the front end of the receiving surface which can be rounded or spade-shaped. The receiving surface is concave as between both side ends.

The scoop is designed to be used with both hands during a bag-filling operation.

One choice for a gripping means are handles incorporated into the scoop by either being integrally molded with the scoop or threadably connected or riveted to the scoop. These handles could be connected to the receiving surface one near each of the side edges or in an alternative design, the handles can be connected near the outside edges on the backside of the scoop.

A second choice, and most preferred, is a pair of handle holes formed in the scoop to permit a person to grip the scoop directly with both hands. The portion of the scoop between each hole and its corresponding side surface defines a pair of handles. Each hole is in close proximity to each side end. The holes are wide enough to permit a person's fingers to pass through. Preferably, the holes are in an elongated elliptical configuration. The most preferred embodiment has the edges of each scoop handle having a heavy wall thickness to provide additional comfort and additional protection against the edges cutting into the hands of a person while gripping the handles. The handles are also sufficiently wide to permit the user to wear gloves which will provide additional comfort.

The scoop can be constructed from any material including steel or wood. Preferably, the scoop would be constructed of a lightweight material such as plastic or aluminum. Most preferably, the scoop is comprised of a single integral piece of a higher density thermo-plastic material such as high density polyethylene or a co-polymer polypropylene. These materials also permit the scoop to be resilient as well as flexible, particularly when the side ends are flexed towards each other over the receiving surface when temporarily securing a bag as will be discussed later.

The most preferred embodiment can be mass produced by an injection molding process thereby reducing the overall cost of manufacture, be lightweight and environmentally safe for disposal after use.

Although not necessary, it is preferred that the scoop have a means integrally attached to the scoop for temporarily securing the bag. Most preferably, the temporary securing means comprises a pair of puncture elements integral with the scoop body. The elements are capable of puncturing through the bag material and sufficiently resilient to thereafter maintain the punctured bag holes disposed about both elements thereby maintaining the rear end disposed within the bag. To ensure a secure fit, after puncturing the bag material with one puncture element, the side ends of the scoop can be flexed toward one another, the second element is then used to puncture the bag material. Following this second puncture step, the resilience of the scoop will tend to displace the side ends back to their original position and cause the bag to fit securely between both puncture elements. If the puncture elements are either not incorporated into the scoop, or alternatively, the elements are not used, the bag can be held in place by the individual gripping a portion of the bag together with the handles while the scoop is partially disposed within the bag.

In order to perform the scooping operation, the rear end of the scoop is disposed within a bag. An individual would then puncture the bag on both sides of the scoop with the puncture elements described above. Once the bag is punctured on both side of the scoop, the scoop is temporarily secured. Because of the concave characteristic of the receiving surface as between both side ends, the bag material between both side ends and the receiving surface form an opening for sand to pass through and be collected within the bag. A person would next grip both handles of the scoop and begin to fill the bag by thrusting the front end of the scoop into sand and thereafter angling the scoop so as to permit the matter disposed on the receiving surface to gravitate into the bag. Alternatively, if the particulate matter is flowing, the scoop need simply be positioned in the flow facing upstream with the scoop slightly angled to permit the flow to gravitate into the bag.

After the bag has been filled, the puncture elements are disengaged from the bag and the scoop completely removed from the bag.

Other features and advantages of the invention will become apparent to those skilled in the art upon review of the following detailed description and claims.

DETAILED DESCRIPTION OF THE PREFERRED EMBODIMENT

Figure 1:
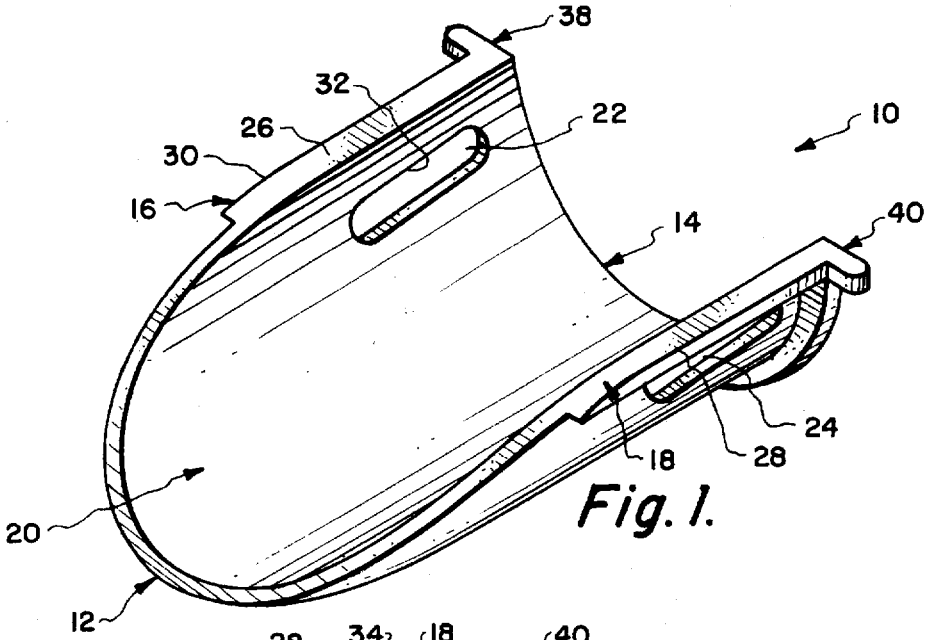
FIG. 1 is a perspective view of the invention.
Figure 2:
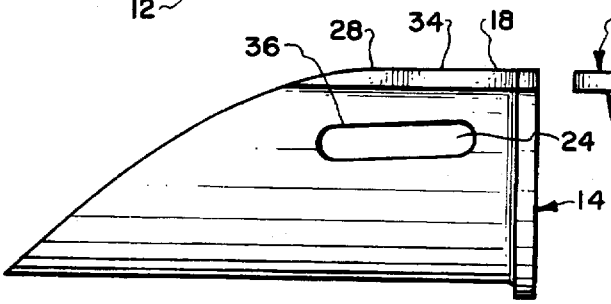
FIG. 2 is a left side elevational view thereof; the right side elevational view being a mirror image thereof.
Figure 3:
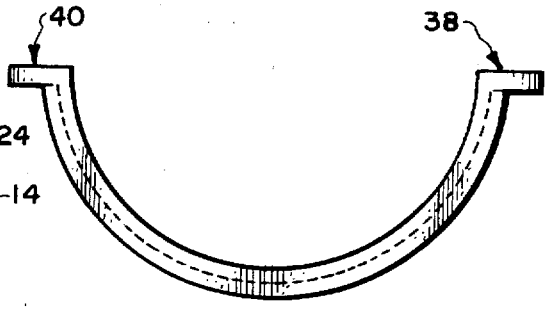
FIG. 3 is a rear elevational view thereof.
Figure 5:
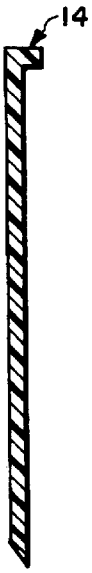
FIG. 5 is a cross-sectional view of the invention taken along line 5—5 in FIG. 4.
Figure 4:
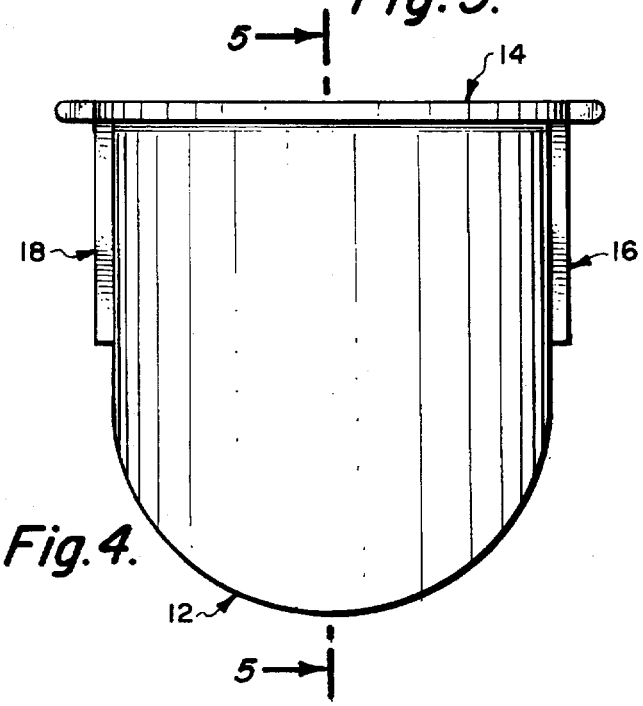
FIG. 4 is a bottom plan view thereof.
Figure 6:
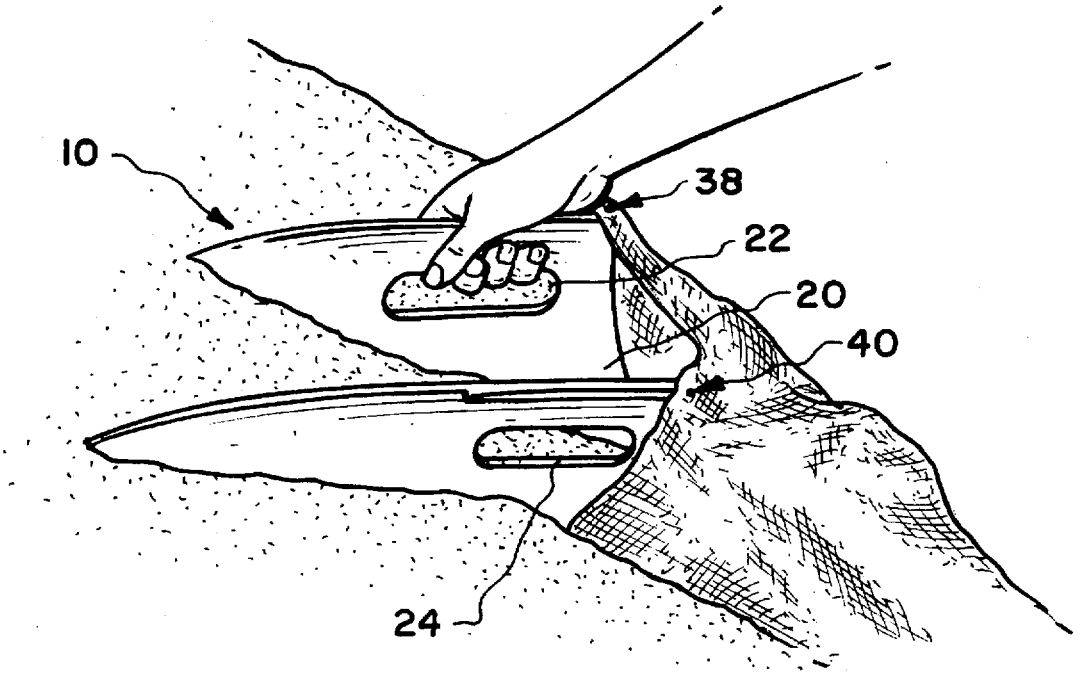
FIG. 6 is a perspective view of the invention in operation. Hand is not shown gripping the left side of invention.

FIG. 1 illustrates the overall structure of the scoop 10 of this invention. The scoop can be injection molded into a single piece using high density thermoplastic material. Such a material provides a superior combination of resilience, strength, impact resistance, light weight and flexibility.

Scoop 10 has a front end 12, a rear end 14, and two side ends 16 and 18. The topside area between front end 12, rear end 14 and side ends 16 and 18 defines a receiving surface 20. Receiving surface 20 is generally concave in relation to side ends 16 and 18 but generally flat as between front end 12 and rear end 14.

Rear end 14 has a heavier wall thickness than the remainder of scoop 10 which tends to maintain the concave contour of receiving surface 20 as between side ends 16 and 18.

Handle holes 22 and 24 are located near side ends 16 and 18 respectively. The general section of scoop 10 between handle hole 22 and side end 16 generally define a handle 26 for a human hand to grip. Likewise, handle 28 is defined as the general section between handle hole 24 and side end 18. Each handle has two edges. Handle 26 has edge 30 defined as that portion of side end 16 opposite handle hole 22 and edge 32 defined as the boundary of handle 26 to handle hole 22. Likewise, handle 28 has edge 34 defined as that portion of side end 18 opposite handle hole 24 and edge 36 defined as the boundary of handle 28 to handle hole 24. Edges 30, 32, 34 and 36 have a wall thickness generally heavier than the surrounding wall thickness of scoop 10. This additional thickness provides additional comfort and prevents the edges from cutting into the skin when a person is gripping handles 26 and 28.

Extending outward from the intersection of rear end 14 and side ends 16 and 18 are puncture elements 38 and 40 respectively. Puncture elements 38 and 40 extend outward from scoop 10 in a direction which is generally parallel to rear end 14.

Although this is the preferred embodiment of this invention, an alternative embodiment comprises all the elements heretofore discussed except for puncture elements 38 and 40.

The preferred embodiment having been described is used in the following manner:

A bag to be filled with a granular substance such as sand is provided. The bag has an opening which is larger than rear end 14 so that it can be disposed within the bag. Puncture elements 38 and 40 are used to puncture through the bag material to temporarily secure scoop 10 to the bag while scoop 10 is partially disposed within the bag. A person grips handles 26 and 28 in such a way that each wrist is closer to rear end 14 than front end 12. Front end 12 is then positioned before a mound or pile of sand which is provided. Scoop 10 is then displaced partially into the mound allowing a portion of the sand comprising the mound to be displaced onto receiving surface 20. Scoop 10 is then angled to all the sand on receiving surface 20 to gravitate into the bag. Scoop 10 is repeatedly displaced into the mound as described above until it is determined that the bag is sufficiently full. Thereafter, the bag is released from engagement with puncture elements 38 and 40 and scoop 10 is removed from the bag.

I claim:

1. A device for collecting particulate matter and directing it into a bag comprising:

a scoop having a receiving surface bound by a front edge, a rear edge, and two side edges;

said side edges generally taper from said rear edge to the front edge of said scoop;

said receiving surface being resilient and generally having a concave contour between said side edges;

said front, rear and side edges being free such that said scoop is flexible across said concave receiving surface from a first position to a second position in a direction towards said side edges whereby said rear edge is insertable with a bag opening;

a puncture element extending away from one of said side edges and located near said rear edge for frictionally gripping a bag disposed around said rear edge when flexed from said second to said first position; and means for gripping said scoop.

2. A device as recited in claim 1, wherein a second puncture element extends away from said second side end and located near said rear end.

3. A device as recited in claim 1, wherein said scoop rear end has a wall thickness which is heavier than the other components of said scoop.

4. A device as recited in claim 1, wherein said gripping means comprises a pair of substantially elongated elliptical holes formed in said scoop, one of said holes positioned in close proximity to one of said side ends, the other of said holes positioned in close proximity to the other of said side ends, each of said holes capable of permitting the fingers of a human hand to pass through and the portions of said scoop located between said holes and their respective side ends defining a pair of handles.

5. A device as recited in claim 1, wherein said scoop is comprised of an integral piece of resilient plastic material.

6. A device for collecting particulate matter and directing it into a bag comprising:

a scoop having a receiving surface bound by a front edge, a rear edge, and two side edges, said scoop having a generally semi-circular profile when viewed from said rear edge;

said side edges generally taper from said rear edge to the front edge of said scoop;

said receiving surface being resilient and generally having a concave contour between said side edges;

said front, rear and side edges being free such that said scoop flexible across said concave receiving surface from a first position to a second position in a direction towards said side edges whereby said rear edge is insertable with a bag opening;

a puncture element extending away from one of said side edges and located near said rear edge for frictionally gripping a bag disposed around said rear edge when flexed from said second to said first position; and means for gripping said scoop.

7. A device as recited in claim 6, wherein a second puncture element extends away from said second side end and located near said rear end.

8. A device as recited in claim 6, wherein said scoop rear end has a wall thickness which is heavier than the other components of said scoop.

9. A device as recited in claim 6, wherein said gripping means comprises a pair of substantially elongated elliptical holes formed in said scoop, one of said holes positioned in close proximity to one of said side ends, the other of said holes positioned in close proximity to the other of said side ends, each of said holes capable of permitting the fingers of a human hand to pass through and the portions of said scoop located between said holes and their respective side ends defining a pair of handles.

10. A device as recited in claim 6, wherein said scoop is comprised of an integral piece of resilient plastic material.

* * * * *